US009546057B2

(12) United States Patent
Ishida et al.

(10) Patent No.: US 9,546,057 B2
(45) Date of Patent: Jan. 17, 2017

(54) SHEET MATERIAL STORAGE, SHEET FEEDING DEVICE, AND IMAGE FORMING APPARATUS

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/008,809

(22) Filed: Jan. 28, 2016

(65) Prior Publication Data

US 2016/0221772 A1 Aug. 4, 2016

(30) Foreign Application Priority Data

Jan. 30, 2015 (JP) ..... 2015-017163

(51) Int. Cl.
*B65H 1/00* (2006.01)
*B65H 1/26* (2006.01)

(52) U.S. Cl.
CPC ..... *B65H 1/00* (2013.01); *B65H 1/266* (2013.01); *B65H 2515/82* (2013.01); *B65H 2601/521* (2013.01)

(58) Field of Classification Search
CPC ..... B65H 1/00; B65H 1/266; B65H 2405/31; B65H 2515/82; B65H 2601/521
USPC ..... 271/145
See application file for complete search history.

(56) References Cited

U.S. PATENT DOCUMENTS 5,096,180 A * 3/1992 Nagaoka ..... G03G 15/6502 271/110
8,317,187 B2 * 11/2012 Kondo ..... B65H 1/266 271/127
8,777,213 B2 * 7/2014 Shimohora ..... G03G 15/6505 271/145
2009/0256304 A1 * 10/2009 Koizumi ..... B65H 7/18 271/10.09
2010/0247178 A1 * 9/2010 Doyou ..... B65H 5/062 399/322
2015/0110517 A1 4/2015 Ishida et al.
2015/0241838 A1 8/2015 Ishida et al.
2015/0243274 A1 * 8/2015 Hirakawa ..... G10K 11/172 399/91
2016/0033928 A1 * 2/2016 Ishimitsu ..... G03G 21/1633 399/91
2016/0152041 A1 * 6/2016 Ishida ..... B41J 2/471 347/260

(Continued)

FOREIGN PATENT DOCUMENTS

JP 2000-112306 A 4/2000
JP 2003-89437 3/2003
JP 2006-256811 9/2006

OTHER PUBLICATIONS

U.S. Appl. No. 14/803,168, filed Jul. 20, 2015.

*Primary Examiner* — David H Bollinger
(74) *Attorney, Agent, or Firm* — Harness, Dickey & Pierce, P.L.C.

(57) ABSTRACT

A sheet material storage includes a housing space structure that forms a housing space to house a sheet material and an acoustic device that uses a Helmholtz resonator. At least a part of a cavity of the Helmholtz resonator is formed in the housing space structure.

20 Claims, 10 Drawing Sheets

(56) References Cited

U.S. PATENT DOCUMENTS

2016/0161904 A1* 6/2016 Matsuda ..... G03G 15/6552
399/91

* cited by examiner

SHEET MATERIAL STORAGE, SHEET FEEDING DEVICE, AND IMAGE FORMING APPARATUS

CROSS-REFERENCE TO RELATED APPLICATION

The present application is based on and claims priority to Japanese patent application No. 2015-017163, filed Jan. 30, 2015, the disclosure of which is hereby incorporated by reference herein in its entirety.

BACKGROUND

Technical Field

The present invention relates to a sheet material storage, sheet feeding device, and image forming apparatus.

Description of Related Art

An image forming apparatus including a sheet feeding device has been conventionally known. The sheet feeding device includes a sheet material storage such as a sheet feeding cassette, which is detachably attached to a main body of the apparatus to store a sheet material such as paper, and a paper feeder such as a paper feeding roller, which abuts on the sheet material stored in the sheet material storage to apply a conveying force.

Patent Literature 1 (Japanese Laid-Open Patent Application No. 2003-89437) describes an image forming apparatus including a sheet feeding device (paper storage) having an acoustic member attached to a bottom face and side faces of an inside of using a paper feeding tray as a sheet material storage member. Patent Literature 1 also describes to use an acoustic device (silencer) using a Helmholtz resonator instead of the acoustic member. Patent Literature 1 describes that noise in a sheet feeding operation is absorbed by the acoustic member to reduce the noise.

SUMMARY

The Helmholtz resonator is constituted by a cavity having a certain volume and a communication portion that communicates between the cavity and an outside. When the acoustic device using such a Helmholtz resonator is used instead of using the acoustic member described in Patent Literature 1, the acoustic device including the cavity which requires a certain volume is added to a sheet material storage as another member, resulting in an increase in size of the sheet material storage. As a result, the size of the entire sheet feeding device is increased.

To solve the above problem, an aspect of the present invention provides a sheet material storage including a housing space structure that forms a housing space to house a sheet material and an acoustic device that uses a Helmholtz resonator. At least a part of a cavity of the Helmholtz resonator is formed in the housing space structure.

DETAILED DESCRIPTION

Hereinafter, an embodiment of an electrophotography copier (hereinafter referred to as a copier 500) as an image forming apparatus will be described with reference to the drawings.

Figure 2:
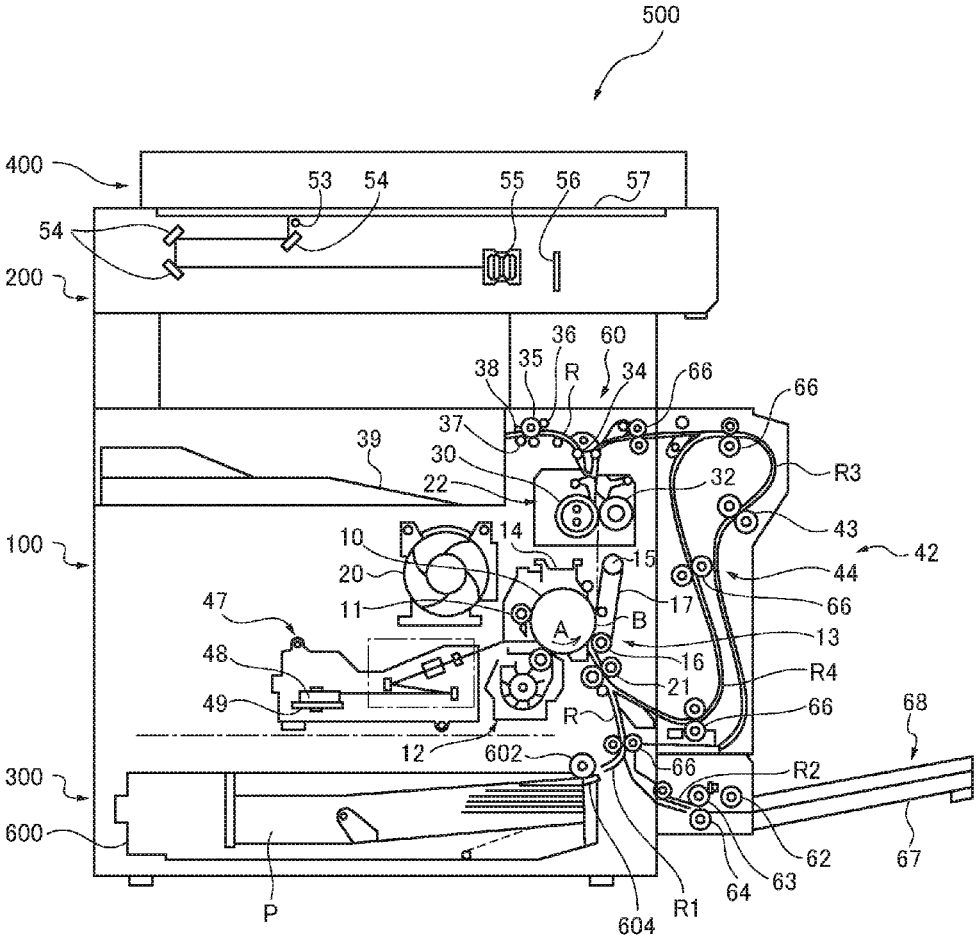
FIG. 2 is a schematic view showing a copier.

FIG. 2 is a schematic view showing the copier 500. A scanner 200 as an image reader is provided on an image forming unit 100 of the copier 500. The image forming unit 100 is placed on a sheet feeding device 300. An automatic document feeder 400 is provided on the scanner 200. The automatic document feeder 400 is rotatable about a rear face (back face in FIG. 2) as a support point. The image forming unit 100 includes inside thereof a photoconductor 10 as a latent image carrier.

Figure 3:
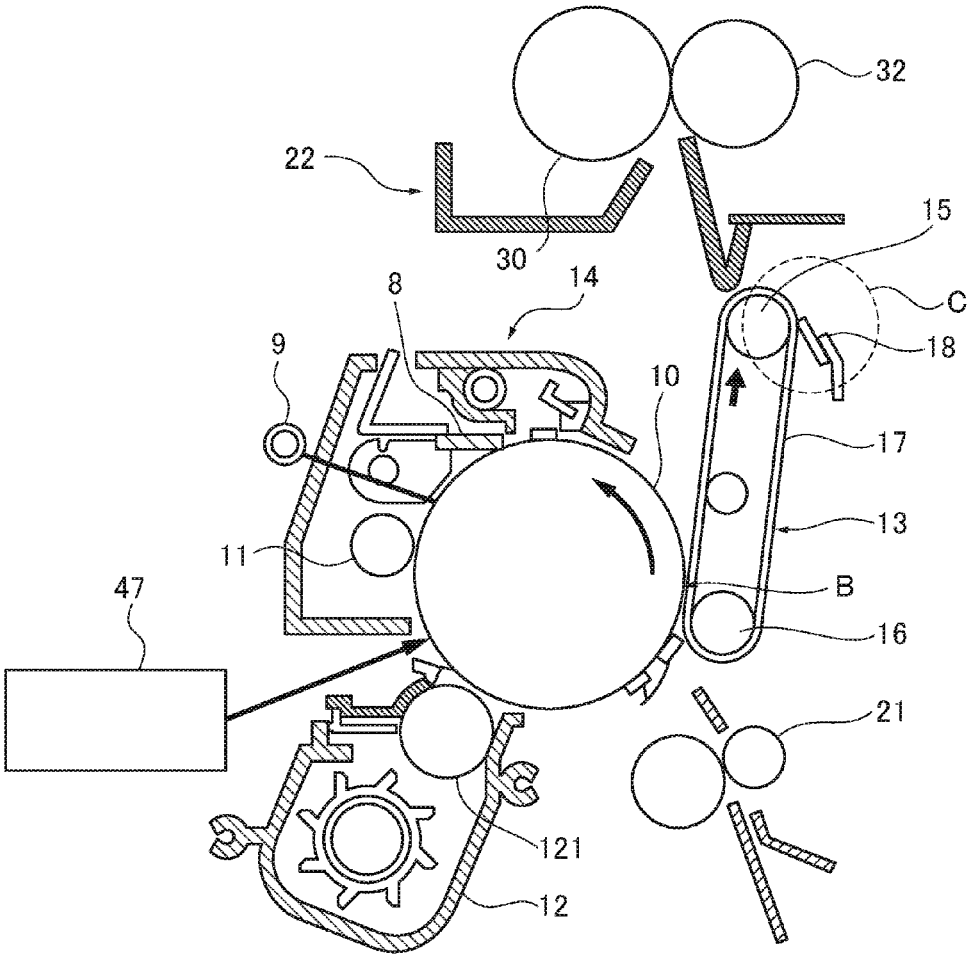
FIG. 3 is a schematic view showing a photoconductor.

FIG. 3 is a schematic view showing the photoconductor 10. As illustrated in FIG. 3, the photoconductor 10 includes therearound a neutralization lamp 9, charging device 11 using a charging roller, developing device 12, transfer device 13, and cleaner 14 having a photoconductor cleaning blade 8. The developing device 12 attaches toner to the electrostatic latent image on the photoconductor 10 by a developing roller 121 as a developer carrier to be visualized.

The transfer device 13 includes a transfer belt 17 wound around a first belt tension roller 15 and a second belt tension roller 16. The transfer belt 17 is pressed to the surface of the photoconductor 10 in a transfer position B which transfers a toner image on the photoconductor 10 to the paper P as a recording medium. A cleaning blade 18 that abuts on the first belt tension roller 15 via the transfer belt 17 is provided in a transfer belt cleaning section C in the downstream of the transfer position B in the surface movement direction of the transfer belt 17.

The image forming unit 100 includes a toner supplier 20 that supplies new toner to the developing device 12. The toner supplier 20 is provided on the left side of the charging device 11 and the cleaner 14 in FIG. 2. The image forming unit 100 includes a paper conveyer 60 that conveys the paper P from a sheet feeding cassette 600 (sheet material storage) of the sheet feeding device 300 to an ejection stack section 39 through the transfer position B. The paper conveyer 60 conveys the paper P along a supply path R1 or manual supply path R2 and a paper conveying path R. A pair of registration rollers 21 is provided on the paper conveying path R in the upstream of the transfer position B in the paper conveying direction.

Figure 4:
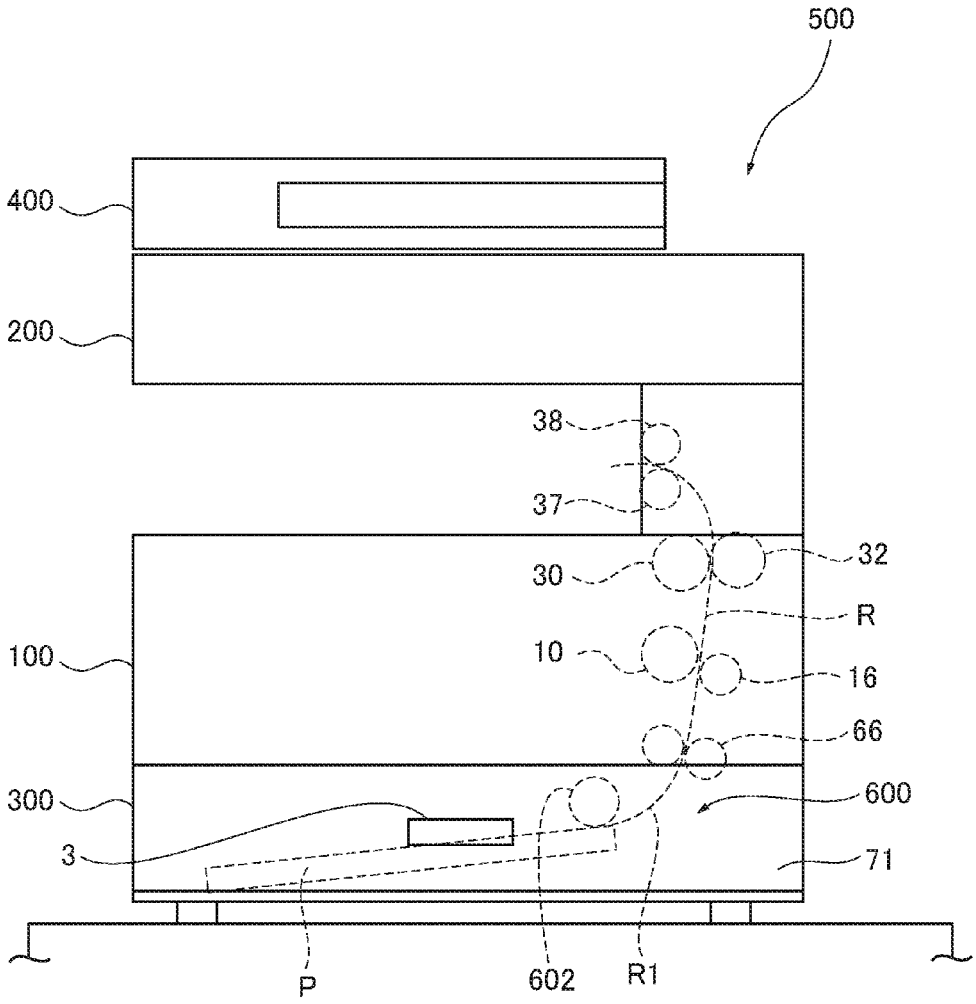
FIG. 4 is a schematic view showing a positional relationship between a paper feeding cassette and each roller that applies a conveying force to paper in the copier.

A thermal fixing device 22 is provided in the downstream of the transfer position B in the paper conveying direction of the paper conveying path R. The thermal fixing device 22 performs a fixing process by sandwiching the paper P between a heating roller 30 as a heating member and a pressure roller 33 as a pressure member. An ejection claw 34, ejection roller 35, first pressure roller 36, second pressure roller 37 and stiffness roller 38 are provided in the downstream of the thermal fixing device 22 in the paper convey direction. The ejection stack section 39 on which the paper P having an image through the thermal fixing device 22 is stacked is also provided in the downstream of the thermal fixing device 22. FIG. 4 is a schematic view showing the positional relationship between the sheet feeding cassette and each roller which applies a conveying force to the paper P in the copier 500.

The image forming unit 100 includes a switchback device 42 on the right side in FIG. 2. The switchback device 42 conveys the paper P along a reverse path R3 which branches from the position where the ejection claw 34 is disposed on the paper conveying path R and a re-conveying path R4 which again guides the paper P through the reverse path R3 to the position of the registration rollers 21 on the paper conveying path R. A pair of switchback rollers 43 is provided in the reverse path R3, and a plurality of paper conveying rollers 66 is provided in the re-conveying path R4.

As illustrated in FIG. 2, the image forming unit 100 includes a laser writer 47 on the left side of the developing device 12. The laser writer 47 includes a laser light source, rotating polygon mirror 48 for scanning, polygon motor 49, and scanning optical system such as an fθ lens.

The scanner 200 includes a light source 53, a plurality of mirrors 54, optical lens 55 for imaging, and image sensor 56 such as a CCD image sensor. A contact glass 57 is provided on the top face of the scanner 200. The automatic document feeder 400 includes a set table for a document and also a stack table for a document in the ejection position of the document. In the automatic document feeder 400, the document set on the set table is conveyed to the stack table via the reading position on the contact glass 57 of the scanner 200 by a plurality of document conveying rollers.

The sheet feeding device 300 includes the sheet feeding cassette 600 that houses the paper P such as a sheet material and an OHP film. The sheet feeding cassette 600 includes a sheet feeding roller 602 and a separation pad 604. The sheet feeding roller 602 abuts on the top sheet of the paper P housed in the sheet feeding cassette 600 to apply the conveying force.

The sheet feeding device 300 includes a manual sheet feeding section 68 on the right side in FIG. 2. The manual sheet feeding section 68 includes a manual feeding tray 67 to be openable and closable relative to the main body of the copier 500. The manual sheet feeding section 68 includes the manual supply path R2 that guides the paper P set on the manual feeding tray 67 to the paper conveying path R. The manual sheet feeding section 68 includes a manual sheet feeding roller 62, supply roller 63, and separation roller 64.

Next, the operation of the copier 500 will be described. When copying a document with the copier 500, at first, a main switch is turned on, and the document is set on the set table of the automatic document feeder 400. When copying a document such as a book, the automatic document feeder 400 is opened, the document is directly set on the contact glass 57 of the scanner 200, and the automatic document feeder 400 is closed to press the document.

After that, upon pressing a start switch, the scanner 200 is driven after the document is moved onto the contact glass 57 when the document is set on the set table of the automatic document feeder 400. The document read by the scanner is ejected on the stack table. On the hand, when the document is directly set on the contact glass 57, the document is read by directly driving the scanner 200. When reading the document, the scanner 200 irradiates the document on the contact glass 57 with the light from the light source 53 while moving the light source 53 along the contact glass 57. The reflection light is guided to the optical lens 55 for imaging by the mirrors 54, and enters the image sensor 56, so that the document is read by the image sensor 56.

In the copier 500, the photoconductor 10 is rotated by a photoconductor driving motor at the same time as reading the document to uniformly change the surface of the photoconductor 10 by the charging device 11. Next, the laser writer 47 irradiates the photoconductor 10 with the laser light to perform laser writing according to the document read by the scanner 200. An electrostatic latent image is thereby formed on the surface of the photoconductor 10. The toner is attached to the electrostatic latent image by the developing device 12 to be visualized as a toner image.

In the copier 500, the paper P in the sheet feeding cassette 600 of the sheet feeding device 300 is fed by the sheet feeding roller 602 at the same time as pressing the start switch. The paper P is separated one by one by the friction against the separation pad 604 when feeding the paper P with the sheet feeding roller 602. One sheet is guided to the supply path R1, and is guided to the paper conveying path R by the paper conveying rollers 66. The paper P conveyed to the paper conveying path R abuts on the registration rollers 21.

When using the manual sheet feeding section 68, the manual feeding tray 67 is opened and the paper P is set on the manual feeding tray 67. The paper P set on the manual feeding tray 67 is fed by the manual sheet feeding roller 62, and is separated one by one by the supply roller 63 and the separation roller 64. One sheet is conveyed to the manual supply path R2, and is guided to the paper conveying path R by the paper conveying rollers 66. The paper P guided to the paper conveying path R abuts on the registration rollers 21. The registration rollers 21 starts rotating in accordance with the entrance of the leading end of the toner image on the photoconductor 10 into the transfer position B, and the stopped paper P is fed to the transfer position B.

The toner image on the photoconductor 10 is transferred onto the paper P, which is fed to the transfer position B, by the transfer device 13, and the surface of the paper P carries the toner image. The residual toner on the surface of the photoconductor 10 after the transfer is removed by the cleaner 14, and the residual electric potential on the photoconductor 10 is eliminated by the neutralization lamp 9, and the photoconductor 10 is prepared for the next image formation.

On the other hand, the paper P onto which the toner image is transferred on the transfer position B is conveyed by the transfer belt 17 and enters the thermal fixing device 22. Heat and pressure are applied to the paper P while being conveyed between the heating roller 30 and the pressure roller 32, and the toner image on the paper P is fixed. After that, stiffness is applied to the paper P by the ejection roller 35, first pressure roller 36, second pressure roller 37, and stiffness roller 38, and is ejected on the ejection stack section 39 to be stacked.

When forming an image on both sides of the paper P, after the ejection claw 34 is switched, and the toner image is transferred onto one side of the paper P to be fixed, the paper P enters the reverse path R3 from the paper conveying path R. After the paper P from the reverse path R3 enters the switchback position 44 by conveying with the paper conveying rollers 66, the paper P is switched back by the switchback rollers 43, enters the re-conveying path R4, and is guided to the paper conveying path R by the paper conveying rollers 66. The toner image is similarly transferred onto the opposite face of the paper P passed through the re-conveying path R4.

Foreign matters such as residual toner and paper powder remained on the transfer belt 17 after the paper P is separated is scraped from the transfer belt 17 by the cleaning blade 18 in the transfer belt cleaning section C.

Embodiment 1

Figure 1:
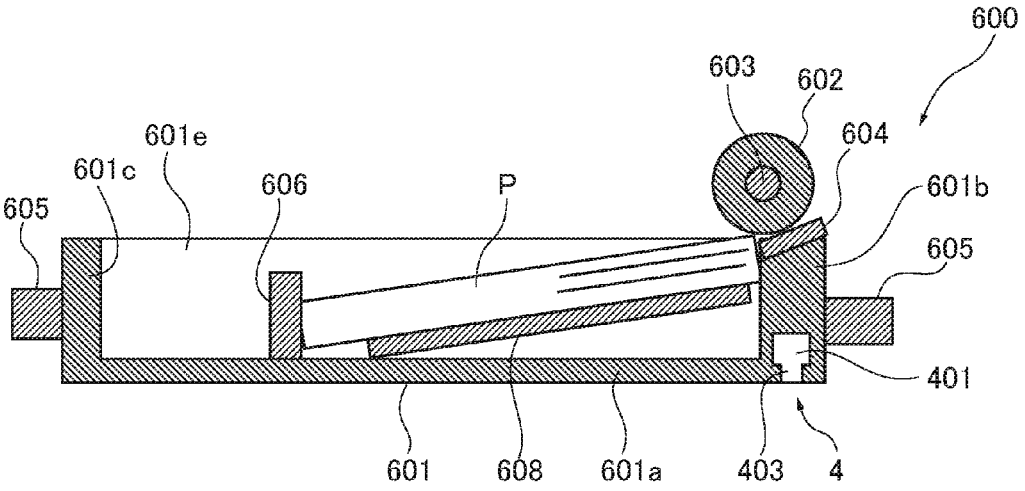
FIG. 1 is a sectional side view showing a sheet feeding cassette in Embodiment 1 of the present invention.
Figure 5:
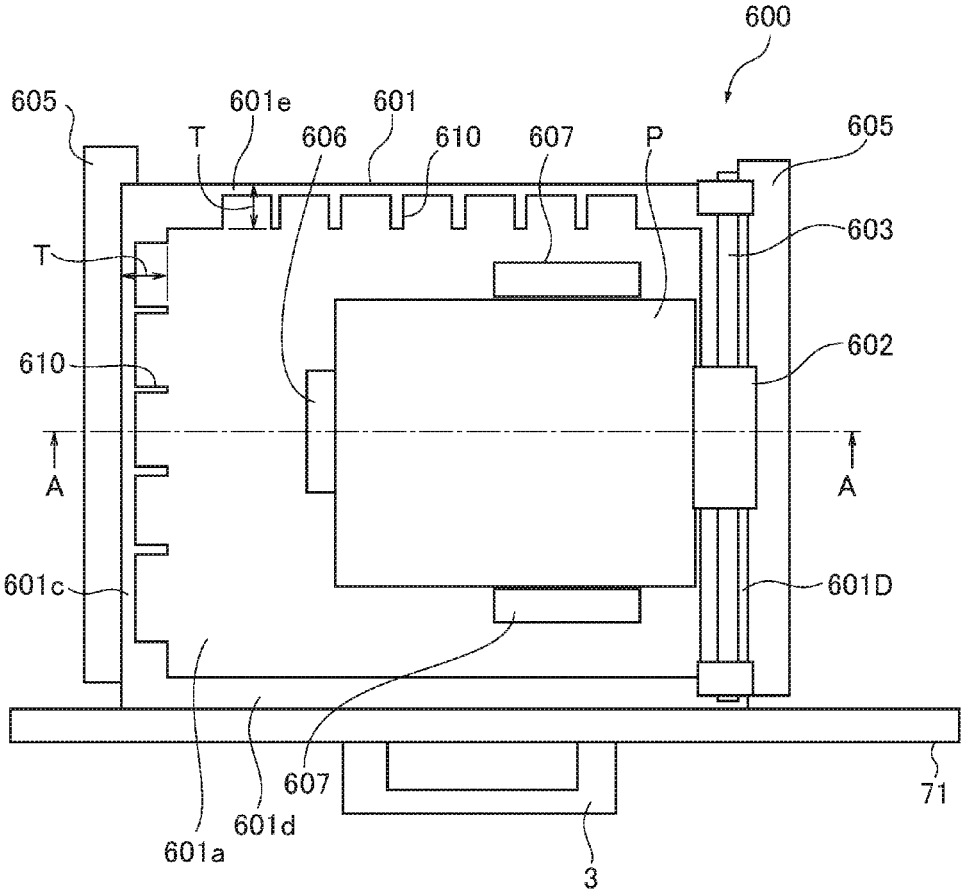
FIG. 5 is a top view showing the sheet feeding cassette in Embodiment 1.

Next, the sheet feeding cassette 600 according to Embodiment 1 will be hereinafter described. FIG. 5 is a top view showing the sheet feeding cassette 600 in Embodiment 1 and FIG. 1 is a sectional side view along an A-A line in FIG. 5 showing the sheet feeding cassette 600 in Embodiment 1.

The sheet feeding cassette 600 includes a casing 601, the sheet feeding roller 602, the separation pad 604, a guide member 605, an end fence 606, side fences 607, an elevation bottom plate 608, a cover 71, and a grip 3. The casing 601 includes a bottom plate 601*a*, right plate 601*b*, left plate 601*c*, front plate 601*d*, and back plate 601*e*. The casing 601 is a box having an opened top face to form a paper housing space housing inside thereof the paper P. The casing 601 is made of a resin material. Plate ribs 610 for securing strength are attached to inner wall faces of the left plate 601*c* and the back plate 601*e* of the casing 601. The end fence 606 and the side fences 607 are made of a resin material. The positions of these fences can be changed in the casing 601 according to the size of the paper P. The guide member 605 is a member that guides the sheet feeding cassette 600 to move along the guide rail of the main body of the sheet feeding device 300 when mounting the sheet feeding cassette 600 to sheet feeding device 300.

The elevation bottom plate 608 is a metal plate member. Before the sheet feeding cassette 600 is mounted on the sheet feeding device 300, the elevation bottom plate 608 is horizontally supported. When the sheet feeding cassette 600 is mounted on the sheet feeding device 300 and power is input to the cassette 600 from the sheet feeding device 300, the elevation bottom plate 608 moves up toward the paper feeding roller 602, as illustrated in FIG. 1. The sheet feeding roller 602 is fastened to a sheet feeding roller shaft 603, and the sheet feeding roller 602 rotates upon the input of the driving force to the sheet feeding roller shaft 603 from the main body with the sheet feeding cassette 600 being mounted on the sheet feeding device 300. Upon the rotation of the sheet feeding roller 602, the conveying force is applied to the paper P on the top of the paper P set in the paper housing space by the friction, and the paper P to which the conveying force is applied is separated one by one by the separation pad 604 to be conveyed to the supply path R1.

In the sheet feeding cassette 600 of Embodiment 1, an acoustic device 4 using a Helmholtz resonator is provided in the casing 601 as a housing space structure. In Embodiment 1, a cavity 401 of the Helmholtz resonator in the acoustic device 4 is formed in the right plate 601*b* of the casing 601.

Figure 6:
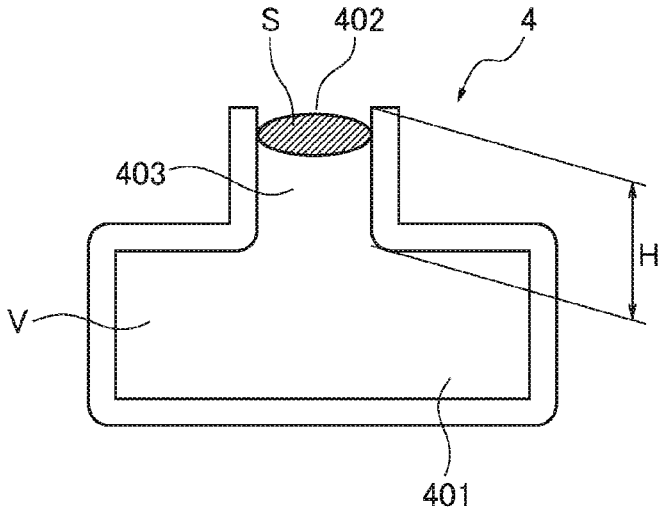
FIG. 6 is a pattern diagram showing an acoustic device using a Helmholtz resonator.

FIG. 6 is a pattern diagram showing the acoustic device 4 using the Helmholtz resonator. As illustrated in FIG. 6, the Helmholtz resonator is a container having a narrowed entrance, and includes the cavity 401 having a certain volume and a neck (communication portion) 403 having a small entrance narrower than the cavity 401, so as to absorb sound of a specific frequency through the neck 403. The following equation (1) is obtained where V is a volume of the cavity 401, S is an opening area of an opening 402 of the neck 403, H is a length of the neck 403, c is a sound speed, and f is an acoustic frequency in the acoustic device 4.

$$f = \frac{c}{2\pi}\sqrt{\frac{S}{V(H+\Delta r)}} \tag{1}$$

$\Delta\gamma$ of the equation (1) is an opening end correction. Where r is a radius when the profile of the neck 403 is circle, $\Delta\gamma=0.6r$ is used. As shown in the equation (1), the frequency of sound that is absorbed by the acoustic device 4 is obtained by V, H, and S.

In the sheet feeding device 300, friction sound is generated between the sheet feeding roller 602 and the paper P and between the top sheet of the paper P and the next sheet under the top sheet of the paper P when conveying the top sheet. The friction sound is also generated between the paper P conveyed by the sheet feeding roller 602 and the separation pad 604. Running sound of the sheet feeding device 300 is transmitted outside the sheet feeding device 300 as a noise which provides uncomfortable feeling to people. By constituting the acoustic device 4 in accordance with the frequency of the running sound as the noise, the running sound as the noise can be absorbed by the acoustic device 4.

In the sheet feeding cassette 600 in Embodiment 1, the cavity 401 which requires a certain volume is formed in the right plate 601*b* of the casing 601. A space required for providing the acoustic device 4 can be thereby controlled. The sheet feeding cassette 600 can be therefore downsized to be smaller than a paper feeding cassette having the Helmholtz resonator as another member of a sheet material housing space. In the sheet feeding device 300 in Embodiment 1, the acoustic device 4 is disposed just below the sheet feeding roller 602 as a sheet feeder. The acoustic device 4 can be disposed close to the sheet feeding roller 602 which is a sound source of the friction sound between the paper feeding roller 602 and the paper P. The sound absorbing effect can be improved.

In Embodiment 1, the cavity 401 is incorporated inside the casing 601, and the neck 403 is also formed in the casing 601. The wall face forming the neck 403 may be a member in addition to a member for forming another wall face of the cavity 401.

Embodiment 2

Figure 7:
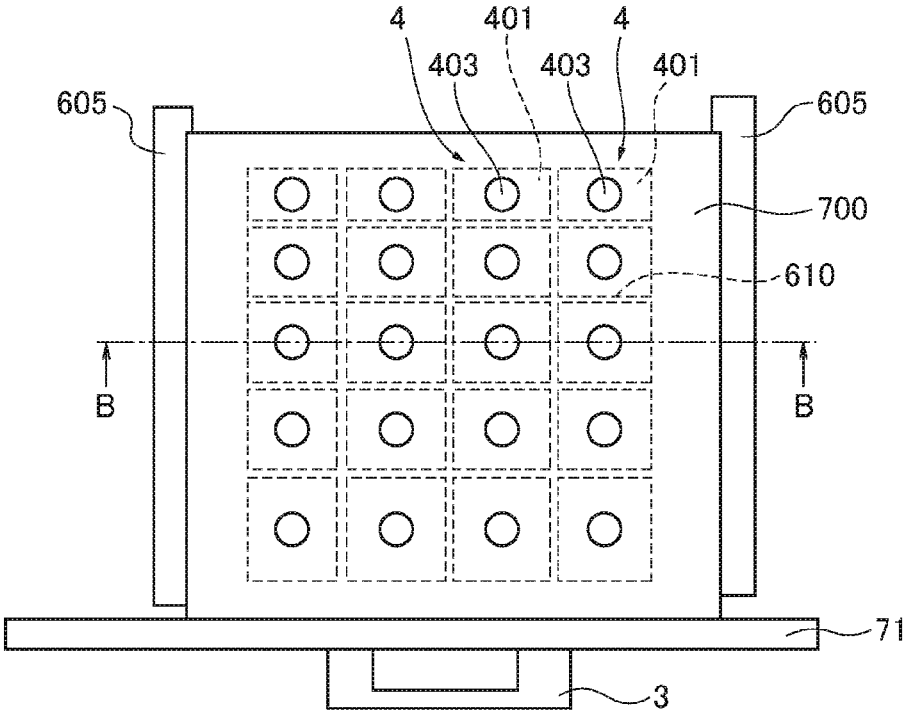
FIG. 7 is a bottom view showing the sheet feeding cassette in Embodiment 2 of the present invention.
Figure 8:
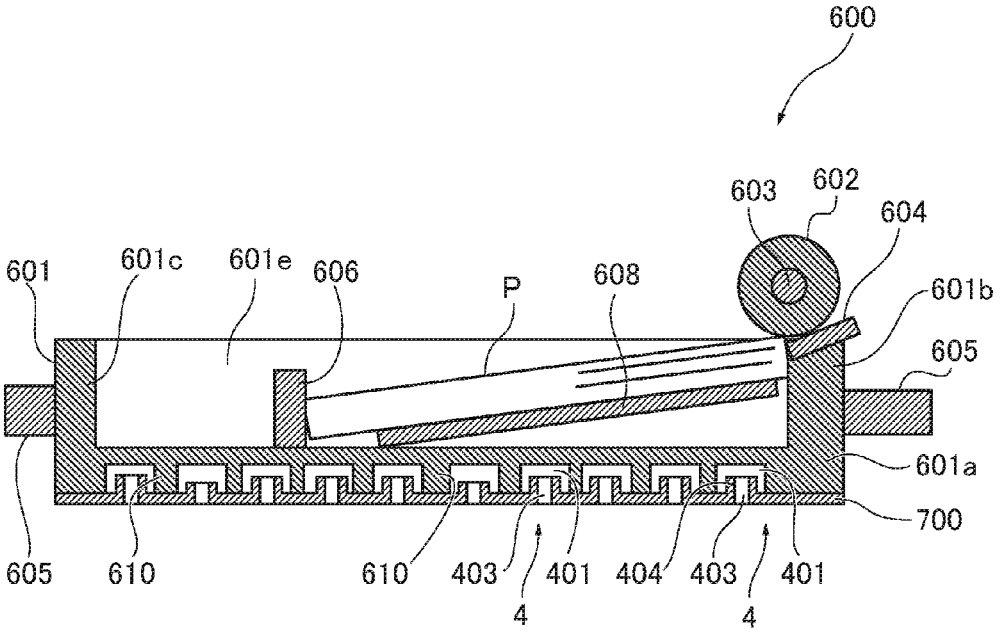
FIG. 8 is a sectional side view showing the sheet feeding cassette in Embodiment 2.
Figure 9:
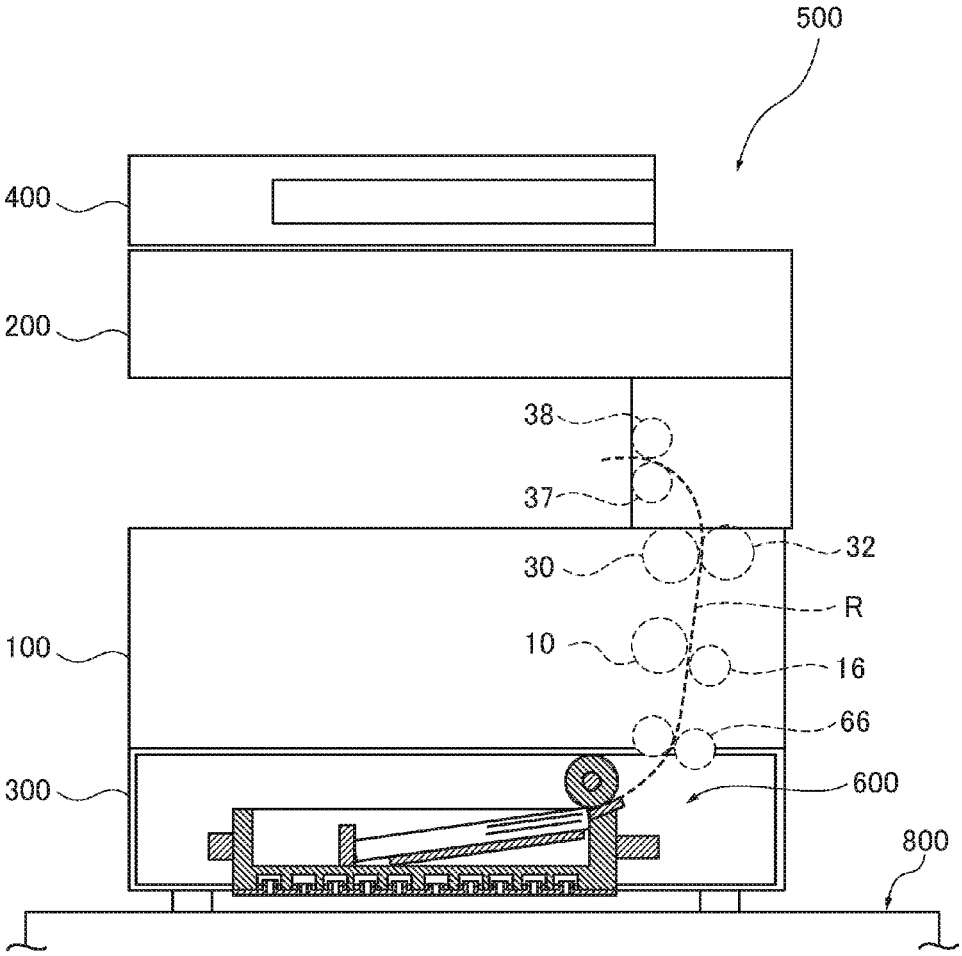
FIG. 9 is a schematic view showing a relationship between the sheet feeding cassette and each roller in a copier including a sheet feeding device in Embodiment 2.

Next, the sheet feeding cassette 600 according to Embodiment 2 will be described. FIG. 7 is a bottom view showing the sheet feeding cassette 600 according to Embodiment 2. FIG. 8 is a sectional side view along a B-B line in FIG. 7 showing the sheet feeding cassette 600 in Embodiment 2. FIG. 9 is a schematic view showing a positional relationship between the sheet feeding cassette 600 and each roller that applies a conveying force to the paper P in the copier 500 including the sheet feeding device 300 having the sheet feeding cassette 600. The acoustic device 4 of the sheet feeding cassette 600 in Embodiment 2 differs from that in Embodiment 1 in its arrangement. Description for the configurations which are common to Embodiments 1 and 2 will be omitted.

In the sheet feeding cassette 600, the acoustic device 4 using the Helmholtz resonator includes a plurality of members. As illustrated in FIG. 8, the sheet feeding cassette 600 includes a plurality of cavities 401 and a plurality of necks 403 of the Helmholtz resonators. The cavities 401 are formed in the bottom plate 601*a* of the casing 601 and the necks 403 are also formed in a lower plate 700 which is a member separated from the casing 601. The number of acoustic devices 4 shown in FIG. 7 is smaller than that show in FIG. 8 for the sake of simplicity, but the number of acoustic devices 4 shown in FIG. 7 is actually the same as that shown in FIG. 8.

The sheet feeding cassette 600 in Embodiment 2 includes the lower plate 700 as a neck forming member, which forms a wall face provided with the necks 403 among the wall faces forming the cavities 401, and the casing 601 as a cavity forming member, which forms another wall face of the cavity 401. Since the frequencies of the sound which are absorbed by the acoustic device differ according to the volume of the cavity 401 and the length and the opening area of the neck 403, a certain level of accuracy is required for the shapes of the cavity 401 and the neck 403 in order to absorb sound of a specific frequency. In the sheet feeding cassette 600 in Embodiment 2, the lower plate 700 as the neck forming member and the casing 601 as the cavity forming member are separately manufactured as separated members. Consequently, the acoustic device 4, which communicates with the outside only by the neck 403, and includes the cavity 401 having a certain level of volume, can be accurately manufactured.

The number of manufacturing processes and also the costs can be reduced by separating manufacturing the cavity 401 and the neck 403. The lower plate 700 can be used in a plurality of models as long as a range which is covered by the lower plate 700 is the same even when the models each having different casing 601 are used.

Figure 10:
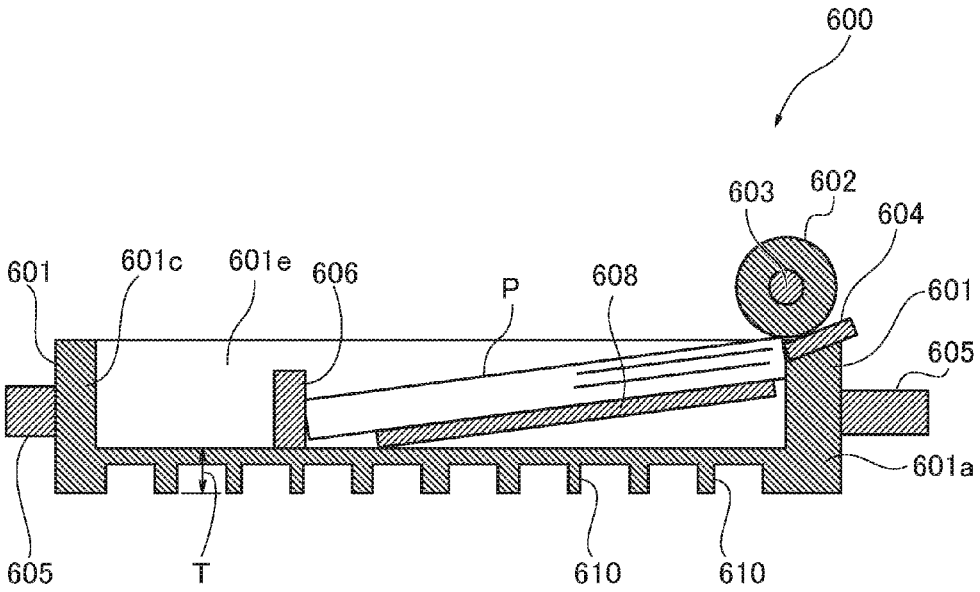
FIG. 10 is a sectional side view showing the sheet feeding cassette in Embodiment 2 from which a bottom plate is removed.

FIG. 10 is a sectional side view showing the sheet feeding cassette 600 from which the lower plate 700 is removed. As illustrated in FIG. 10, the bottom plate 601*a* of the casing 601 includes a plurality of ribs 610 protruding in the normal direction of the surface of the plate instead of increasing the thickness of the plate 601*a*, in order to enhance the strength of the plate. The acoustic device 4 using the Helmholtz resonator is formed by covering the bottom plate 601*a* provided with the ribs 610 with the lower plate 700 having a plurality of holes.

Spaces are formed between the ribs 610. These spaces can be used as the cavities 401 of the Helmholtz resonators by attaching the lower plate 700 to the face provided with the ribs 610 of the bottom plates 601*a* in the sheet feeding cassette 600 of Embodiment 2. At least a part of the cavity 401 can be thereby formed in the thickness range (T in FIG. 10) of the bottom plate 601*a* including the rib 610. An increase in the size of the sheet feeding cassette 600 due to the acoustic device 4 can be controlled with the configuration including the acoustic device 4 using the Helmholtz resonator.

The lower plate 700 as the cavity forming member is made of a resin material or a metal material. When the lower plate 700 is made of the metal material, the neck 403 is formed by performing a drawing process, for example, a burring process to a metal plate. A short tube 404 protruding in the normal direction of the plate is thereby formed by the burring process. The inside of the short tube 404 is used as the neck 403 having a sectional area S and a length H.

The burring process is a method of forming a short tube around an opening by forming a hole as a prepared hole in the plate material, pressing a punch having a diameter larger than that of the prepared hole into the prepared hole, and rising the edge of the prepared hole while expanding the edge. By forming the neck 403 with the burring process, the neck 403 can be formed without additionally providing the member for forming the neck 403 in the lower plate 700 forming a part of the wall face forming the cavity 401. The length H of the neck 403 can be increased by forming the neck 403 with the burring process to be longer than that of a neck formed by opening a hole in a plate material (the length H of the neck 403 is the thickness of the plate material). When the frequencies of the sound to be absorbed are the same, the opening area S of the neck 403 can be set to be relatively large. Thus, the sound absorption effect is improved.

The length of the short tube 404 is increased and the length H of the neck 403 is increased as a difference between the diameter of the prepared hole and the diameter of the punch is increased in the burring process. According to the above Equation (1), the frequency of the sound to be absorbed can be lowered by increasing the length H. Consequently, the acoustic device 4, which absorbs the sound of a lower frequency, can be manufactured by reducing the diameter of the prepared hole without changing the opening area (S) when the neck 403 is formed with the burring process.

When the neck 403 is formed with the burring process, the lower plate 700 is disposed such that the short tube 404 forming the neck 403 is located inside the cavity 401. The leading end of the short tube 404 may be sharpened. However, the edge of the short tube 404 can be prevented from being touched by a user when the short tube 404 is placed inside the cavity 401.

When the lower plate 700 is made of a metal material, it is preferable for the lower plate 700 to be electrically connected with another member made of a metal material such as the sheet feeding roller shaft 603 and the elevation bottom plate 608. When the member made of the metal material independently exists without being grounded, the member may be charged or discharged by friction or the like. A control substrate which controls each component of the copier 500 is disturbed by noise due to the discharge, resulting in an improper operation. When the sheet feeding cassette 600 is mounted on the copier 500, the sheet feeding roller shaft 603 and the elevation bottom plate 608 are electrically connected with the ground path of the copier 500.

By electrically connecting the lower plate 700 with another member made of a metal material which is electrically connected with the ground path, the discharge in the lower plate 700 can be thus prevented. Moreover, by electrically connecting the lower plate 700 with another member made of a metal material such as the sheet feeding roller shaft 603 and the elevation bottom plate 608, it becomes unnecessary to add a new wiring which directly electrically connect the lower plate 700 with the ground path of the main body of the copier 500. An increase in the costs can be thus controlled.

Since the metal material has a density larger than that of the resin material, the transmission sound can be controlled when the acoustic device 4 is made of the metal material, so that the sound leakage can be controlled. The resin material is a material which can be processed easier than the metal material. The volume of the cavity 401 can be secured with high accuracy while maintaining a sealing performance compared to the configuration in which all of the wall faces forming the cavity 401 are made of the metal material. Sound of a specific frequency can be therefore absorbed by securing the volume of the cavity 401 with high accuracy.

As illustrated in FIG. 9, when the sheet feeding cassette 600 in Embodiment 2 is mounted on the copier 500, the neck 403 of the acoustic device 4 of the sheet feeding cassette 600 opens downward, and faces a base 800 on which the copier 500 is placed. With this configuration, the sound generated from the sheet feeding device 300 and the copier 500 and reflected by the base 800 can be absorbed by the acoustic device 4. When two or more sheet feeding cassettes 600 in Embodiment 2 are provided in the up and down direction, the acoustic device 4 of the upper sheet feeding cassette 600 absorbs the sound reflected by the casing of the lower sheet feeding cassette 600 and the paper P housed in the casing.

Figure 11:
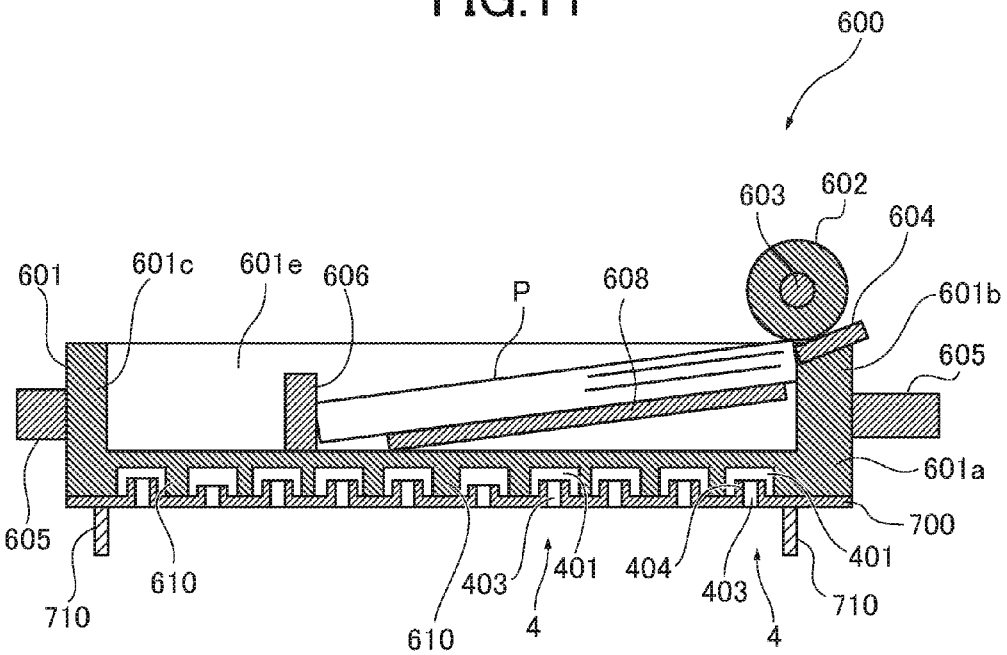
FIG. 11 is a sectional side view showing the sheet feeding cassette in Embodiment 2 in which a protrusion is provided in a bottom face.

FIG. 11 is a sectional side view of the sheet feeding cassette 600 in Embodiment 2 to which a protrusion 710 is provided in the bottom face of the sheet feeding cassette 600. In the configuration illustrated in FIG. 11, the protrusion 710 surrounds a region where the necks 403 of the bottom face of the sheet feeding cassette 600 are formed. With this protrusion 710, the sound transmitted to the space between the lower face of the sheet feeding cassette 600 and the base 800 can be controlled from being leaked outside the space, and the sound can be collected toward the necks 403. The sound absorption effect can be therefore improved.

When airflow is generated around the opening of the neck 403, such airflow disturbs the resonance. The sound absorption effect of the acoustic device 4 using the Helmholtz resonator may be lowered. On the other hand, as illustrated in FIG. 11, by surrounding the opening by the protrusions 710, the airflow around the opening can be prevented. A decrease in the sound absorption effect caused by the airflow around the opening can be controlled, and the sound can be effectively absorbed.

The protrusion 710 is not limited to a shape surrounding the entire region of the circumference portion of the necks 403 of the bottom face. A space can be formed in the protrusion as long as the protrusion has a shape which prevents the leakage of the sound and the airflow around the opening.

Embodiment 3

Figure 12:
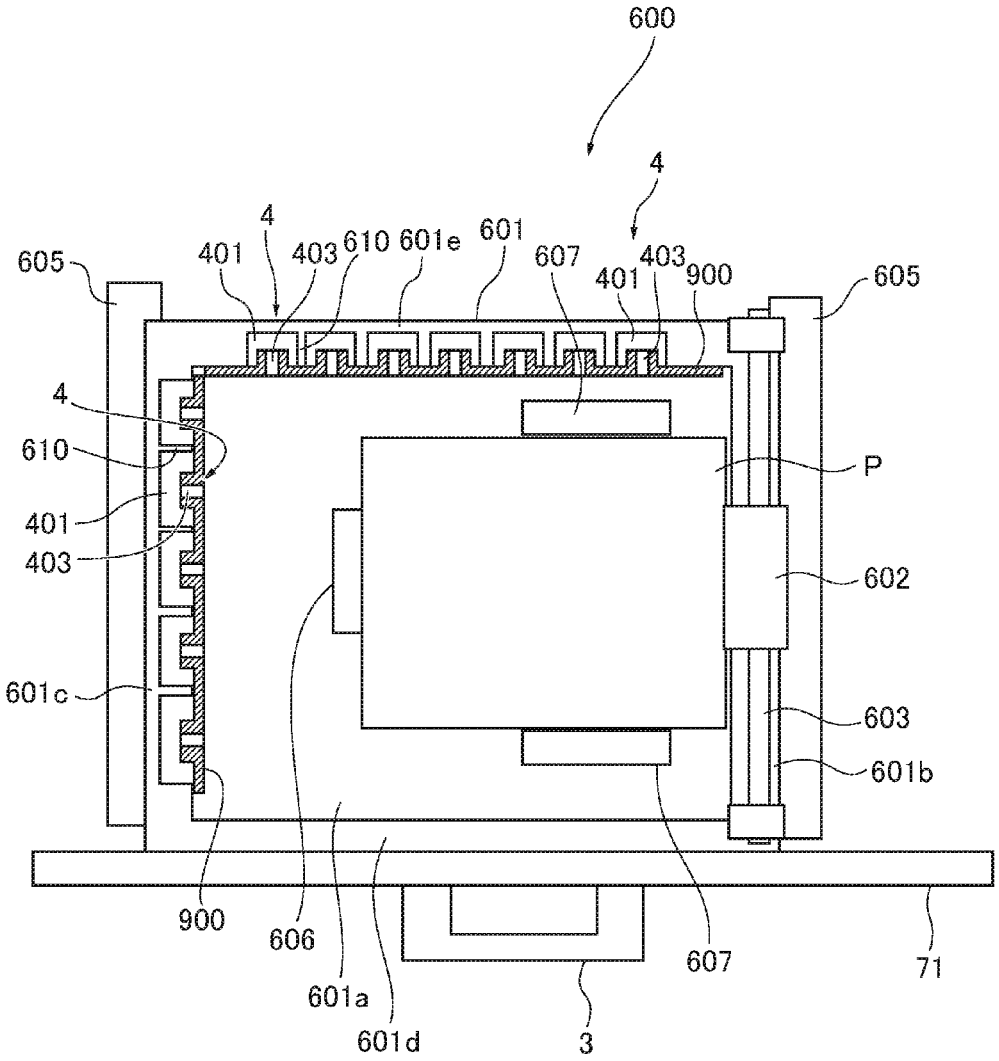
FIG. 12 is a top view showing a sheet feeding cassette in Embodiment 3.

Next, the sheet feeding cassette 600 according to Embodiment 3 will be described. FIG. 12 is a top view showing the sheet feeding cassette 600 of Embodiment 3. The sheet feeding cassette 600 of Embodiment 3 differs from those of Embodiments 1 and 2 in its arrangement. The description for the configurations common to Embodiments 1 and 2 will be omitted.

As illustrated in FIG. 12, the left plate 601*c* and the back plate 601*e* of the casing 601 include a plurality of ribs 610 protruding in the normal direction of the surface of the plates, so as to enhance the strength of the plates instead of increasing the thickness of the plates. The spaces are formed between the ribs 610, and an inner face forming plate 900 is attached to the faces of the left plates 601*c* and the back plate 601*e* provided with the ribs 610, so that the spaces are used as the cavities 401 of the Helmholtz resonator. Consequently, at least a part of the cavity 401 can be formed in the left plate 601*c* and the back plate 601*e* provided with the ribs 610 (range shown by T in FIG. 5). An increase in the size of the paper feeding cassette 600 due to the acoustic device 4 can be prevented by this acoustic device 4 using the Helmholtz resonator.

As illustrated in FIG. 12, in the acoustic device 4 of the sheet feeding cassette 600 in Embodiment 3, the necks 403 of the Helmholtz resonator are disposed to face the inside of the housing space of the paper P. The sound generated around the paper P when conveying the paper P such as the friction sound between the sheet feeding roller 602 and the paper P and between the top sheet and the next sheet just under the top sheet of the paper P when conveying the top sheet can be absorbed. In Embodiment 3, the ribs 610 are provided in the left plate 601*c* and the back plate 601*e*, and the inner face forming plate 900 is also assembled to the left plate 601*c* and the back plate 601*e* to form the acoustic device 4. However, the similar acoustic device may be formed in the front plate 601*d*.

The neck 403 may be disposed in the bottom face of the housing space to face upward as the configuration in which the neck 403 faces the inside of the housing space. However, when the neck 403 is disposed in the bottom face of the housing space, the neck 403 is closed by the surface of the paper P, so that the sound may not be absorbed. On the other hand, when the neck 403 is provided in the side faces of the housing space as described in Embodiment 3, the sound absorption performance can be maintained without closing the neck 403 by the surface of the paper P.

The inner face forming plate 900 as the neck forming member may be made of a resin material or a metal material. When the inner face forming plate 900 is made of a metal material, the neck 403 is formed by conducting a burring process to a metal plate. When the metal material is used, the inner face forming plate 900 is electrically connected with another member made of a metal material such as the sheet feeding roller shaft 603 and the elevation bottom plate 608.

When the ribs are provided in the casing 601 for enhancing the strength, the rib may be broken if a user touches the rib having an insufficient thickness. On the other hand, in Embodiments 2 and 3, the rib 610 forms at least a part of the wall of the cavity 401 of the Helmholtz resonator, and the leading end of the rib 610 is covered by the lower plate 700 or the inner face forming plate 900. With this configuration, the rib 610 can be prevented from being touched by a user, and also from being broken.

In the sheet feeding cassette 600 in Embodiments 1 to 3, the wall faces, which form the cavity 401 of the Helmholtz resonator, in addition to the wall face provided with the neck 403 are formed by the casing 601. The cavity 401 can be thereby formed in the casing 601. An increase in the size of the cassette 600 due to the Helmholtz resonator including the cavity 401 having a certain volume can be prevented.

In the above embodiment, the sheet feeding cassette 600 includes the sheet feeding roller 602. However, a sheet feeder may be provided in the main body of the sheet feeding device without providing the sheet feeder such as the sheet feeding roller 602 in the sheet feeding cassette 600. In this embodiment, the copier 500 as a monochrome image forming apparatus is described as the imaging forming apparatus including the sheet feeding device 300. However, the present embodiment can be similarly applied to a known color image forming apparatus. The image forming apparatus is not limited to the electrophotography image forming apparatus. A known image forming apparatus such as an inkjet image forming apparatus can be used. The image forming apparatus including the paper feeding device 300 is described. The paper feeding device 300 can be applied to an optional paper feeding device which is separated from the main body of the image forming apparatus and connected to the image forming apparatus, so as to increase the number of sheet feeding cassettes. In the above embodiment, the sheet feeding roller 602 is used as the sheet feeder. However, the sheet feeder is not limited to a roller. An endless belt can be used for the sheet feeder.

In the image forming apparatus such as the copier 500, the front, back, right and left faces are covered by the external cover, and the top face is covered by the automatic document feeder (ADF). However, the sheet conveying sound easily leaks from the bottom face since the bottom face has the opening for securing the conveying path of the paper from the sheet feeding bank or the sheet feeding cassette is provided in the lower portion of the device. To prevent such sound leakage from the bottom face, a member which covers the entire face of the bottom face may be provided. However such a member may increase a size of the device. On the other hand, in the copier 500 of this embodiment in which the acoustic device 4 using the Helmholtz resonator is provided in the casing 601 as the component of the sheet feeding cassette 600, an increase in the size of the main body of the copier 500 can be minimized, and the sound leakage from the bottom face can be prevented.

The effects of examples according to the embodiments of the present invention are described below.

Example A

The sheet material storage such as the sheet feeding cassette 600 includes the housing space structure such as the casing 601 that forms the housing space to house the sheet material such as the paper P and the acoustic device 4 that uses the Helmholtz resonator, wherein at least a part of the cavity 401 of the Helmholtz resonator is formed in the housing space structure. According to this Example, as described in the above embodiments, a space required for providing the acoustic device can be reduced by forming the cavity required for a certain level of volume. The sheet material storage including the acoustic device using the Helmholtz resonator can be therefore downsized.

Example B

In Example A, the communication portion 403 that communicates between the outside and the inside of the cavity 401 of the Helmholtz resonator is disposed to face downward. According to this Example, as described in the above embodiments, the sound generated from the sound source such as the sheet feeding device 300 or the copier 500 and is reflected by the surface such as the base 800 on which the main body of the device such as the sheet feeding device 600 is placed can be absorbed by the acoustic device 4.

Example C

In Example A or Example B, the communication portion 403 that communicates between the outside and the inside of the cavity 401 of the Helmholtz resonator is disposed to face the inside of the housing space. According to this Example, as described in the above embodiments, the sound generated when conveying a sheet material such as the paper P can be absorbed.

Example D

In any one of Examples A to C, the Helmholtz resonator includes a plurality of members such as the lower plate 700. According to this Example, as described in the above embodiments, the acoustic device 4 that communicates with the outside only by the communication portion 403 and has the cavity 401 having a certain level of volume can be manufactured with a high accuracy.

Example E

In any one of Examples A to D, the protrusion 710 is provided in the external face of the wall provided with the communication portion 403 that communicates between the outside and the inside of the cavity among the walls that form the cavity 401 of the Helmholtz resonator. According to this Example, as described in the above embodiments, since the sound can be concentrated toward the communication portion, the sound absorption effect can be improved.

Example F

In any one of Examples A to E, the wall provided with the communication portion that communicates between the outside and the inside of the cavity is made of a metal member among that walls that form the cavity 401 of the Helmholtz resonator. According to this Example, as described in the above embodiments, since the metal material has a density higher than that of the resin material, and the transmission sound can be controlled, the sound leakage can be controlled.

Example G

In Example F, the communication portion 403 is formed by the drawing process such as the burring process. According to this Example, as described in the above embodiments, the acoustic device 4 which absorbs the sound of a lower frequency can be obtained without changing the opening area S of the communication portion 403 by reducing the diameter of the prepared hole before processing.

Example H

In Example G, the short tube 404 that forms the communication portion 403 is incorporated in the cavity 401. According to this Example, as described in the above embodiments, the edge of the short tube can be prevented from being touched by a user.

Example I

In Examples F to H, the metal member such as the lower plate 700 that constitutes the wall provided with the communication portion 403 is electrically connected with the conductive member in a main body of the device that accommodates the sheet material storage such as the sheet feeding cassette 600. According to this Example, as described in the above embodiments, the metal member constituting the wall provided with the communication portion can be prevented from being discharged.

Example J

The paper feeding device 300 includes the sheet material housing member that is detachably attached to the main body of the apparatus to house the sheet material, and the sheet feeder such as the sheet feeding roller 602 that applies the conveying force to the sheet material housed in the sheet material housing member, wherein the sheet material housing member includes the sheet material storage such as the sheet feeding cassette 600 according to any one of Examples A to I. According to this Example, as described in the above embodiments, the sheet feeding device including the acoustic device using the Helmholtz resonator can be downsized.

Example K

In Example J, the acoustic device 4 is disposed below the sheet feeder such as the sheet feeding roller 602. According to this Example, as described in the above embodiment, since the acoustic device can be disposed in a position close to the sheet feeder as a sound source, the sound absorption effect can be improved.

Example L

The image forming apparatus such as the copier 500 includes the image forming unit 100 that forms an image on the sheet material such as the paper P as a recording medium, and the sheet material feeder that feeds the sheet material to the image forming unit, wherein the sheet material feeder includes the sheet feeding device according to Example J or Example K. According to this Example, as described in the above embodiments, the image forming apparatus including the paper feeding device having the acoustic device using the Helmholtz resonator can be downsized.

According to the embodiments of the present invention, the sheet material storage including the acoustic device using the Helmholtz resonator can be downsized. Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A sheet material storage comprising:

a housing space structure that forms a housing space to house a sheet material; and an acoustic device including a cavity and an opening, wherein at least a part of the cavity is formed in the housing space structure.

2. The sheet material storage according to claim 1, wherein a communication portion, to communicate between an outside and an inside of the cavity of the acoustic device, which forms the opening, is disposed to face downward.

3. A sheet feeding device comprising:

a sheet material housing member, detachably attached to a main body, to house a sheet material; and a sheet feeder, to apply a conveying force to the sheet material housed in the sheet material housing member, wherein the sheet material housing member includes the sheet material storage according claim 2.

4. The sheet feeding device according to claim 3, wherein the acoustic device of the sheet material storage includes a Helmholtz resonator.

5. An image forming apparatus comprising:

an image forming unit to form an image on a sheet material as a recording medium; and a sheet material feeder to feed the sheet material to the image forming unit, wherein the sheet material feeder includes the sheet feeding device according to claim 3.

6. The sheet material storage according to claim 1, wherein a communication portion, to communicate between an outside and an inside of the cavity of the acoustic device, which forms the opening, is disposed to face an inside of the housing space structure.

7. The sheet material storage according to claim 1, wherein the acoustic device includes a plurality of members.

8. The sheet material storage according to claim 1, wherein a protrusion is provided in an external face of a wall provided with a communication portion, to communicate between an outside and an inside of the cavity and which forms the opening among walls that form the cavity of the acoustic device.

9. The sheet material storage according to claim 1, wherein a wall provided with a communication portion, to communicate between an outside and an inside of the cavity and which forms the opening, is made of a metal member among walls that form the cavity of the acoustic device.

10. The sheet material storage according to claim 9, wherein the communication portion is formed by a drawing process.

11. The sheet material storage according to claim 10, wherein a short tube that forms the communication portion is incorporated in the cavity.

12. The sheet material storage according to claim 9, wherein the metal member of the wall provided with the communication portion is electrically connected with a conductive member in a main body accommodating the sheet material storage.

13. A sheet feeding device comprising:

a sheet material housing member, detachably attached to a main body, to house a sheet material; and a sheet feeder, to apply a conveying force to the sheet material housed in the sheet material housing member, wherein the sheet material housing member includes the sheet material storage according claim 1.

14. The sheet feeding device according to claim 13, wherein the acoustic device is disposed below the sheet feeder.

15. An image forming apparatus comprising:

an image forming unit to form an image on a sheet material as a recording medium; and a sheet material feeder to feed the sheet material to the image forming unit, wherein the sheet material feeder includes the sheet feeding device according to claim 14.

16. The image forming apparatus according to claim 15, wherein the acoustic device of the sheet material storage includes a Helmholtz resonator.

17. An image forming apparatus comprising:

an image forming unit to form an image on a sheet material as a recording medium; and a sheet material feeder to feed the sheet material to the image forming unit, wherein the sheet material feeder includes the sheet feeding device according to claim 13.

18. The image forming apparatus according to claim 17, wherein the acoustic device of the sheet material storage includes a Helrnholtz resonator.

19. The sheet feeding device according to claim 13, wherein the acoustic device of the sheet material storage includes a Hehnholtz resonator.

20. The sheet material storage according to claim 1, wherein the acoustic device includes a Helmholtz resonator.

* * * * *